US011833399B2

(12) United States Patent
Thrash et al.

(10) Patent No.: US 11,833,399 B2
(45) Date of Patent: Dec. 5, 2023

(54) GOLF CUP LIGHTING FIXTURE

(71) Applicants: Bucky Day Thrash, Prosper, TX (US); Dusty Lee Thrash, Lubbock, TX (US)

(72) Inventors: Bucky Day Thrash, Prosper, TX (US); Dusty Lee Thrash, Lubbock, TX (US)

(73) Assignee: Nite Putter Pro, LLC, Prosper, TX (US)

( * ) Notice: Subject to any disclaimer, the term of this patent is extended or adjusted under 35 U.S.C. 154(b) by 0 days.

(21) Appl. No.: 17/716,840

(22) Filed: Apr. 8, 2022

(65) Prior Publication Data

US 2022/0323839 A1 Oct. 13, 2022

Related U.S. Application Data

(60) Provisional application No. 63/172,932, filed on Apr. 9, 2021.

(51) Int. Cl.

| | |
|---|---|
| ***A63B 57/40*** | (2015.01) |
| ***F21V 31/00*** | (2006.01) |
| ***F21V 33/00*** | (2006.01) |

(52) U.S. Cl.

CPC ..... *A63B 57/40* (2015.10); *F21V 31/005* (2013.01); *F21V 33/008* (2013.01); *A63B 2225/74* (2020.08)

(58) Field of Classification Search

CPC ..... A63B 57/40; A63B 2225/74; A63B 2220/833; F21V 31/005; F21V 33/008

USPC ..... 473/174–179, 150–159, 162, 171–196, 473/230; 362/270, 275, 287, 371, 427, 362/293

See application file for complete search history.

(56) References Cited

U.S. PATENT DOCUMENTS

| | | | | |
|---|---|---|---|---|
| 3,902,057 | A * | 8/1975 | La Violette | F21S 43/51 340/431 |
| 8,864,333 | B2 * | 10/2014 | Burkart | A63B 57/357 362/249.02 |
| 10,737,154 | B1 * | 8/2020 | Burch | A63B 57/40 |
| 2009/0197691 | A1 * | 8/2009 | Mullen | A63B 57/40 473/176 |
| 2010/0197420 | A1 * | 8/2010 | Lim | A63B 57/40 473/409 |
| 2016/0025287 | A1 * | 1/2016 | Philhower | F21S 8/022 362/183 |
| 2017/0276303 | A1 * | 9/2017 | Chen | F21V 23/0414 |

* cited by examiner

*Primary Examiner* — Nini F Legesse
(74) *Attorney, Agent, or Firm* — Scale LLP

(57) ABSTRACT

This disclosure provides a golf cup lighting fixture. The system includes a cup, a light source, a catch removeably coupled to the cup. The system also includes a cover located below the catch which covers the light source. The light source is accessible when the catch and cover are removed. The cup can be placed in a hole and then the light source illuminates the hole. A golfer can see the illuminated hole. Replacing the light source, or performing maintenance, is enhanced as the cup need not be removed to conduct such maintenance.

16 Claims, 12 Drawing Sheets

SECTION B-B
SCALE 1 : 1

SECTION A-A
SCALE 1 : 1

GOLF CUP LIGHTING FIXTURE

PRIORITY

The present application claims priority to U.S. Provisional Application No. 63/172,923, filed Apr. 9, 2021, the entirety of which is hereby incorporated by reference.

BACKGROUND

Technical Field

The present disclosure generally relates to in-ground lighting systems and in particular to a golf cup lighting fixture.

Description of the Related Art

A golfer will unlikely score her best if playing golf outdoors during times of low light conditions or when visibility is limited, such as at while sunlight limited at dawn, dusk, and night or in the midst of fog or down-pouring rain. A common way to assist the golfer with seeing the location of the golf ball hole on the putting green, a person will often place a flag-stick in the golf ball hole to indicate the location of the hole. The flag-stick is a tall pole with a flag at the top. Another way to assist the golfer with seeing the location of the golf ball hole is to illuminate the hole in the ground, especially during low light conditions. Specifically, a cylindrical golf-hole cup is installed in the golf ball hole, and a light source is placed in the golf-hole cup to provide illumination inside golf-hole cup and upward from the hole.

There is a need for a way to illuminate the golf ball hole so that the user can play during times of low light conditions.

BRIEF DESCRIPTION OF THE DRAWINGS

The accompanying figures illustrate certain embodiments and may aid in a more complete understanding of this disclosure. This disclosure makes reference to the following figures, in which.

DETAILED DESCRIPTION

FIGS. 1 through 16, discussed below, and the various embodiments are used to describe the principles of the present invention in this patent document. The embodiments illustrated are to be understood as examples and in no way limited of the overall scope of this disclosure. One skilled in the art will understand that the principles of the invention may be implemented in any type of suitably arranged device or system. Throughout the drawings, like reference numbers refer to like elements, features, and structures.

Figure 1:
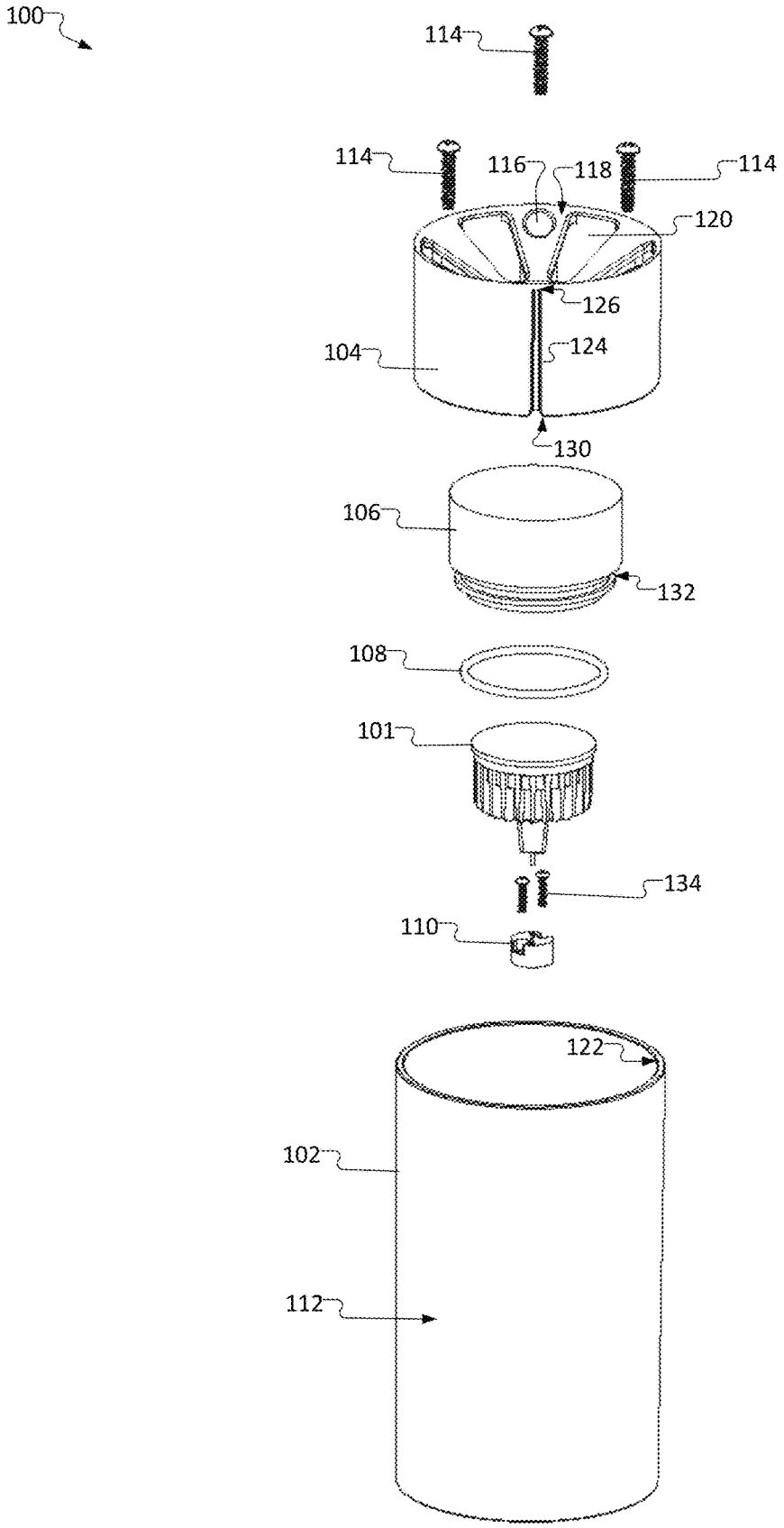
FIG. 1 illustrates an exploded view of a golf cup lighting fixture and a light source according to one or more embodiments of the present disclosure.

FIG. 1 illustrates an exploded view of a golf cup lighting fixture 100 and a light source 101 according to one or more embodiments of the present disclosure. Although certain details will be provided with reference to the components of golf cup lighting fixture 100, it should be understood that other embodiments may include more, less, or different components. The golf cup lighting fixture 100 includes a golf-ball cup 102, ball-catch 104, light source cover 106, gasket 108, and light source socket 110.

In one embodiment, the golf-ball cup 102 is installed (e.g., inserted) in a golf ball hole in the ground. For example, the golf-ball cup 102 can be installed by a landscape professional, who inserts golf-ball cup 102 into the golf ball hole in raw earth. The golf-ball cup 102 functions as a liner and a frame for the golf ball hole. As shown, the exterior surface 112 of the golf-ball cup 102 is shaped as a circular cylinder that slidably fits inside the golf ball hole such that the exterior surface 112 is in contact with the soil beneath the ground level (i.e., surface level). The cylindrical shape is provided for illustrative purposes only and should not be deemed limiting. Other shapes such as square, polygonal, oval, etc. can also be used. In one embodiment the golf-ball cup 102 remains in the golf ball hole throughout the operational life of the product. During maintenance, such as replacing the light source 101, the golf-ball cup 102 remains in the golf ball hole in the ground, without need for removal. This has many advantages as discussed in more detail below. However, it should be noted that removing the golf ball cup 102 is often complicated and can disturb the ground around the cup. Consequently, being able replace the light source 101, as an example, without removing the golf ball cup 102 is an advantage.

In one embodiment, the golf-ball cup 102 is made from a rigid material that remains substantially the same size, regardless of shifts in the temperature, moisture content, or position of the surrounding soil. In at least one embodiment, the golf-ball cup 102 and the ball-catch 104 are made from the same material. Examples of the rigid material(s) used to make golf-ball cup 102 and/or ball-catch 104 are plastic, metal, or polymer, such as aluminum, polypropylene, or acrylonitrile butadiene styrene (ABS). These are non-limiting examples.

By remaining in the ground during replacement of the light source, the golf-ball cup 102 provides an advantage of eliminating the time and energy that would be consumed by a person (i) manually removing a conventional golf cup from soil to access a light source or battery pack disposed beneath the conventional golf cup and (ii) manually re-inserting the conventional golf cup into the golf ball hole to allow a play to resume. Removing a conventional golf cup from the golf ball hole disturbs the soil compaction at the ground-level surface, creating a raised ground-level at the perimeter of the golf-ball hole relative the ground-level before removal of the conventional golf cup. On average, there are approximately 30-50 nails surrounding the perimeter of each golf-ball cup that is installed with artificial turf at the ground level. Removing a conventional golf cup from a golf ball hole that is surrounded artificial turf not only disturbs soil compaction (making the soil less suitable for anchoring nails and staples), but also lifts, loosens, and wrinkles the turf that was affixed (e.g., nailed or stapled) to ground prior to the removal of the conventional golf cup. Re-inserting the conventional golf cup into the golf ball hole is difficult because the soil inside the golf ball hole shifts toward the center of the hole, shrinking the space previously occupied by the conventional golf cup.

In one embodiment, the ball-catch 104 removably attaches to golf-ball cup 102. That is, ball-catch 104 can be detached and removed from golf-ball cup 102, as well as re-attached and re-installed into golf-ball cup 102. When ball-catch 104 is removed from golf-ball cup 102, in one embodiment, the light source cover 106 is accessible to a hand of a person who reaches inside golf-ball cup 102. The golf cup lighting fixture 100 provides an advantage of enabling a person to both remove golf-ball catch 104 and change the light source 101 while golf-ball cup 102 remains installed in the golf-ball hole, in-ground.

The ball catch 104 can removeably couple to the golf ball cup 102 via any method or device known in the art. This can include magnets, friction fit, etc. In one embodiment mechanical fasteners such as screws, nails, bolts, snaps, or the like can be utilized. The figures depict screws, but this is for illustrative purposes only and should not be deemed limiting. Mechanical fasteners can be used to attached the ball-catch 104 to the golf-ball cup 102. In the embodiment shown in FIG. 1, multiple screws 114 attach the ball-catch 104 to a platform 902 (FIG. 9) that is hidden from view inside of golf-ball cup 102. The ball-catch 104, in the embodiment depicted, has multiple (e.g., three) open-top screw channels 202 (FIG. 2), each able to receive a screw 114 and screwdriver through a round opening 116 at the top of the channel. Each of the screws 114 screws through a respective screw hole 516 (FIG. 5) at the bottom of each open-top screw channel 202 and farther into a threaded screw hole 904 (FIG. 9) at the top of the platform 902.

In one embodiment, and as depicted, the top surface 118 of the ball-catch 104 is pitched downward—meaning ball-catch 104 has a downward slope from its outer perimeter to its central inner perimeter. The downward pitch directs liquid (e.g., precipitation) down in the direction of the ground beneath golf cup lighting fixture 100, and inward in the direction of the center of ball-catch 104. The top surface 118 of the ball-catch 104 includes multiple drainage holes 120 that enable liquid to drain down in the direction of the ground beneath golf cup lighting fixture 100. The ball-catch 104 is made from a rigid material, such as aluminum or hard plastic.

As noted, in one embodiment the ball-catch 104 has a circular cylindrical shape that is concentric with the inner surface 122 of the golf-ball cup 102. That is, the outer diameter of ball-catch 104 is smaller than the inner diameter of the golf-ball cup 102. In one embodiment, the outer wall of the ball-catch 104 includes at least one keyhole 124 (e.g., female alignment mechanism) that enables the openings 116 to vertically align with corresponding threaded screw holes 904 at the top of the platform 902 hidden from view inside of golf-ball cup 102. The keyhole 124 includes a recessed groove (e.g., slot) having a bottom end and a top end 126, with one opening 130 at the bottom end. The size and shape of keyhole 124 mates with a protruding key 504 (FIGS. 5, 9, and 10) (i.e., male alignment mechanism) inside golf-ball cup 102. That is, the keyhole 124 receives protruding key 504 through the opening 130, allowing a top end of protruding key 504 to slide within the recessed groove up into contact with top end 126, which blocks farther sliding. In some embodiments, the outer wall of ball-catch 104 includes multiple keyholes 124, for example, three keyholes 124 positioned equidistant (i.e., 120°) apart from each other.

The light source cover 106 includes a hollow interior compartment that is dimensioned to contain light source 101. In one embodiment the light source cover 106 is made of a clear, substantially transparent material that allows light from light source 101 to shine through. The light source cover 106 protects light source 101 from exposure to moisture and other environmental factors. In at least one embodiment, the substantially transparent light source cover 106 is made of a rigid, waterproof material that prevents particulate matter and moisture from entering. For example, the substantially transparent light source cover 106 can be made of an acrylic material, polycarbonate material. In at least one embodiment, the light source cover 106 is made of a material that is UV stabilized, namely protecting the light source cover from long-term degradation from ultraviolet radiation. In one embodiment the light source cover 106 comprises optics which narrow the beam angle and direct the light out of the cup 102. In one embodiment said optics are adjustable.

In one embodiment, the light source cover 106 includes an annular groove 132 in which a gasket 108 fits. In at least one embodiment, the annular groove 132 is a rod flange into which an O-ring fits. Together, a piston seal is formed when the gasket 108 (e.g., the O-ring) is positioned in the annular groove 132 (e.g., positioned round the rod flange). Together, the light source cover 106 and gasket 108, are fully submersible in water and do not allow moisture to enter the interior of light source cover 106 where a light source 101 is contained. The gasket 108 seals the light source cover 106 to the golf-ball cup 102 such that moisture cannot enter a space beneath the light source cover 106 where the light source socket 110 electrically connects to a light source 101. In the embodiment shown in FIG. 1, the gasket 108 is a rod flange O-ring. It is understood that the gasket 108 can be any suitable seal, such as flexible seals, or other annular gaskets. In at least one embodiment, the gasket 108 has an IP68 rating according to the Ingress Protection Code established by the International Electrotechnical Commission (IEC).

Figure 11:
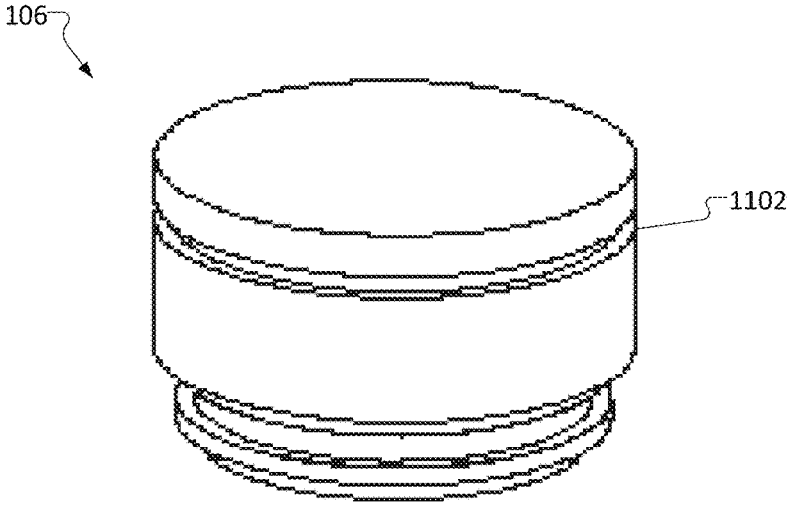
FIG. 11 illustrates a light source cover with a gripping groove, according to one or more embodiments of the present disclosure.

The golf cup lighting fixture 100 provides an advantage of enabling the light source cover 106 to be removed without tools. More particularly, the fingers of a person (e.g., having hands the size of an average adult male in the U.S.A.) can grip the outer circumference of the light source cover 106 inside the golf-ball cup 102, and pull up to remove the light source cover 106 from the golf-ball cup 102. Similarly, a light source 101 can be removed by hand, without any tools. In at least one embodiment, as illustrated in FIG. 11, the light source cover 106 includes a gripping groove 1102, according to one or more embodiments of the present disclosure. The gripping groove 1102 is a recessed groove that adds additional grip for a landscape professional to remove light source cover 106.

The light source socket 110 enables the light source 101 to connect to an electrical power source. In the embodiment shown in FIG. 1, the light source socket 110 is a bi-pin socket, for example, an MR16 socket. It is understood that light source socket 110 is not limited to connecting with two-pin light bulbs, and that the light source socket 110 can be any suitable type lamp socket for connecting with a corresponding light bulb connector, including but not limited to bayonet cap, Edison screw cap, or compact fluorescent base. In one embodiment the light source socket 110 is mechanically fastened to the golf-ball cup 102 by screws 134 or the like. In one embodiment, the interior of the golf-ball cup 102 includes screw holes 906 (FIG. 9) for fastening with screws 134.

The light source 101 can be any suitable light source. It can be a traditional bulb. In the example shown, the light source 101 is a smart light emitting diode (LED) that is controllable by a mobile application on a smartphone. The mobile application can control any feature available on such applications. This can include the full spectrum of color temperatures, operation of the light source 101, schedules, etc. Other embodiments of light source 101 can include an LED bulb that is not controllable by a mobile application, or an array of LEDs.

Figure 2:
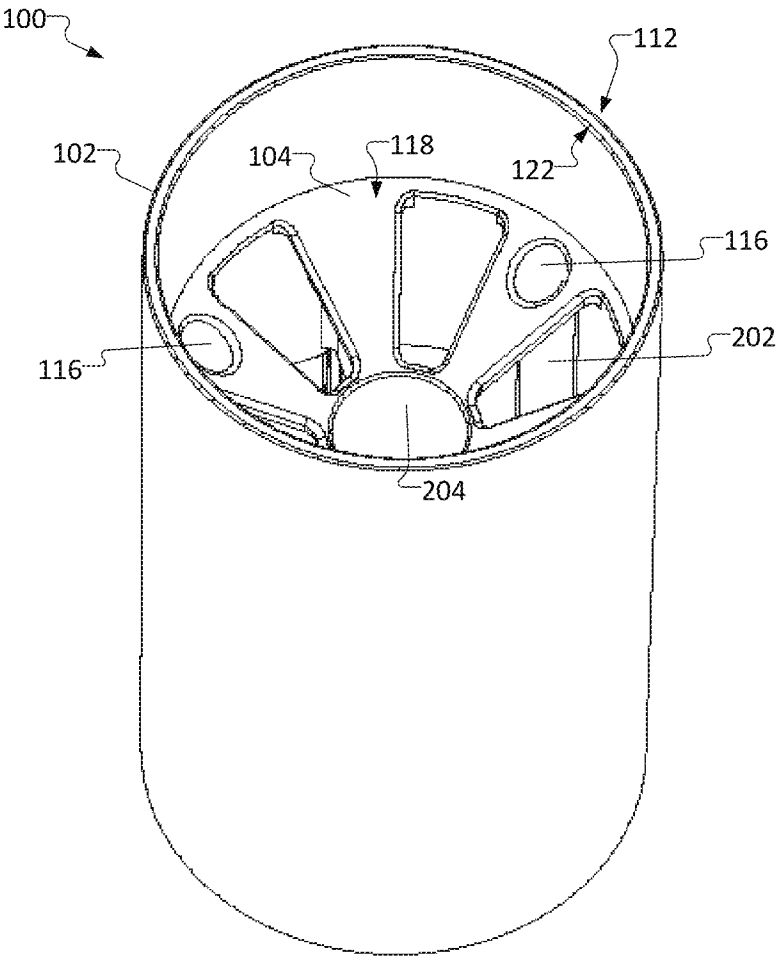
FIG. 2 illustrates a top perspective view of the golf cup lighting fixture of FIG. 1, assembled according to one or more embodiments of the present disclosure.

FIG. 2 illustrates a top perspective view of a golf cup lighting fixture 100 of FIG. 1. As shown, the top surface 118 of ball-catch 104 has multiple round openings 116, each at the dimensioned to allow a screw 114 and screwdriver to enter and pass through respective open-top screw channels 202. Each open-top screw channel 202 has walls that guide the screw and screwdriver straight down to the bottom of the channel. The inner diameter of the open-top screw channel 202 is dimensioned to prevent a screw 114 from rotating 90° into a horizontal orientation, and dimensioned to prevent the shaft of a screwdriver from bypassing the screwhead within the channel.

In one embodiment, the ball-catch 104 includes a flag-stick hole 204 though the center. The flag-stick hole 204 is a circular cylindrical shaped hole for a flag-stick to pass through. In at least one embodiment, the flag-stick hole 204 is dimensioned to support a flag-stick or pole that complies with USGA rules—meaning a flag-stick that has a constant diameter of no greater than 0.75 inches (approximately 19 mm) from a point 3 inches (approximately 76.2 mm) above to 3 inches below the putting green surface.

Figure 3:
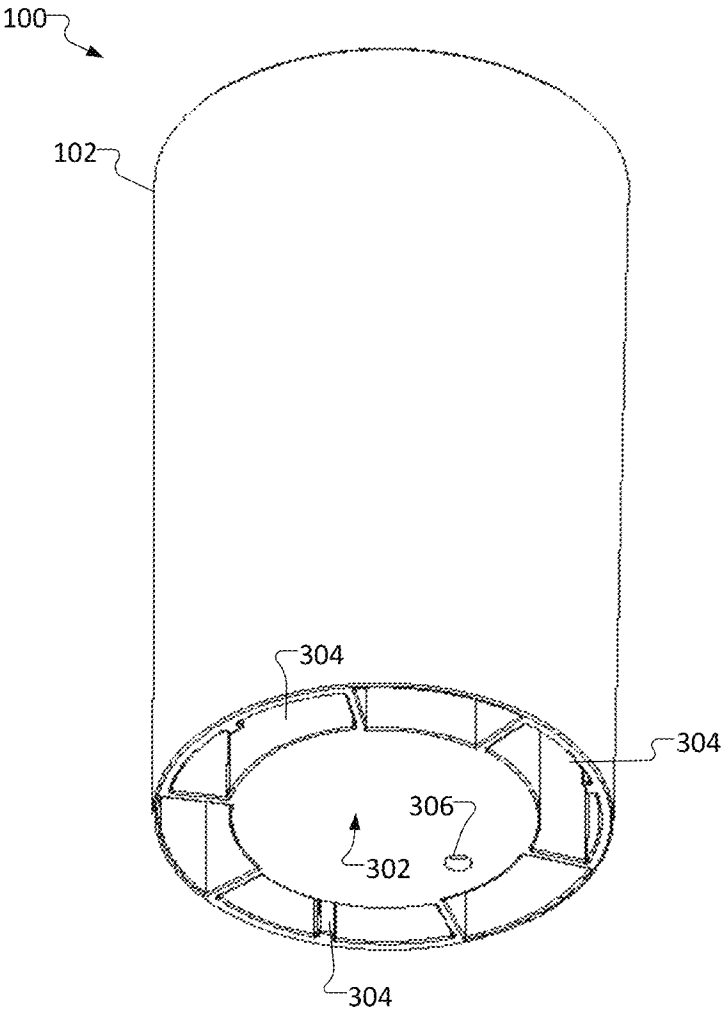
FIG. 3 illustrates a bottom perspective view of the golf cup lighting fixture of FIG. 2.

FIG. 3 illustrates a bottom perspective view of the golf cup lighting fixture 100 of FIG. 2. In one embodiment, the bottom surface 302 of the golf-ball cup 102 includes one or multiple drainage holes 304 that enable liquid to drain down out of golf cup lighting fixture 100 and into the surrounding soil. In at least one embodiment, a bottom surface 302 includes three (3) drainage holes 304. By guiding liquid though the drainage holes 304 in the bottom surface 302 of the golf-ball cup 102, the golf cup lighting fixture 100 provides an advantage of enabling a person to avoid expending time and energy associated with removing a conventional golf cup in order to pour out liquid accumulated in the closed bottom of the conventional golf cup.

In one embodiment, and as shown, the bottom surface 302 of the golf-ball cup 102 includes cable port 306, through which cables pass in order to connect to external electric circuit components. For example, wires inside one golf cup lighting fixture 100 can connect to wires (e.g., cables) of another golf cup lighting fixture 100, and multiple golf cup lighting fixtures 100 can connect to and share a common electric transformer. In at least one embodiment, the wires are potted (for example, set into glue that provides a water-tight seal) at the cable port 306.

Figure 4:
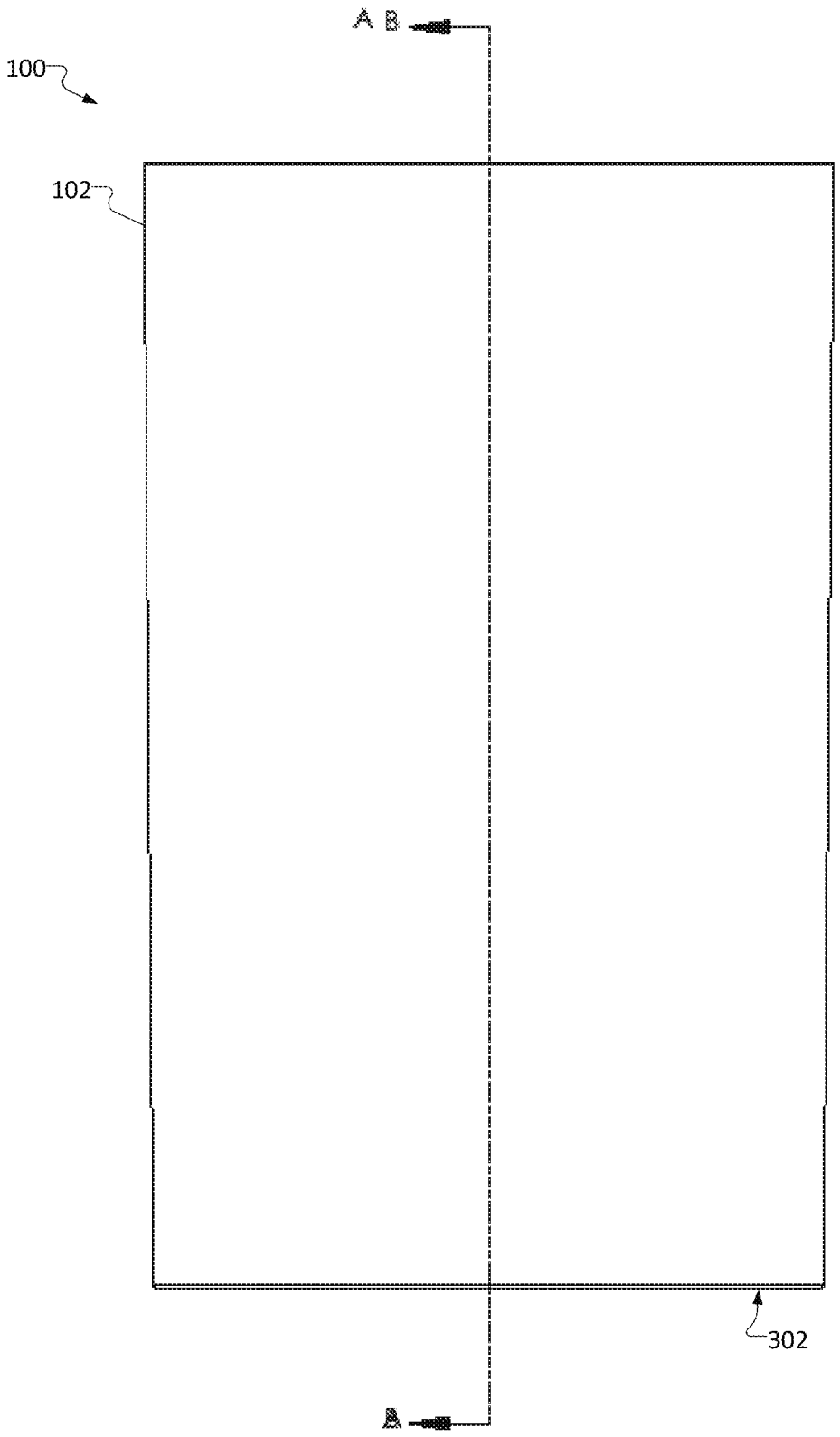
FIG. 4 illustrates a side view of the golf cup lighting fixture of FIG. 1 assembled with the light source installed therein, according to one or more embodiments of the present disclosure.
Figure 5B:
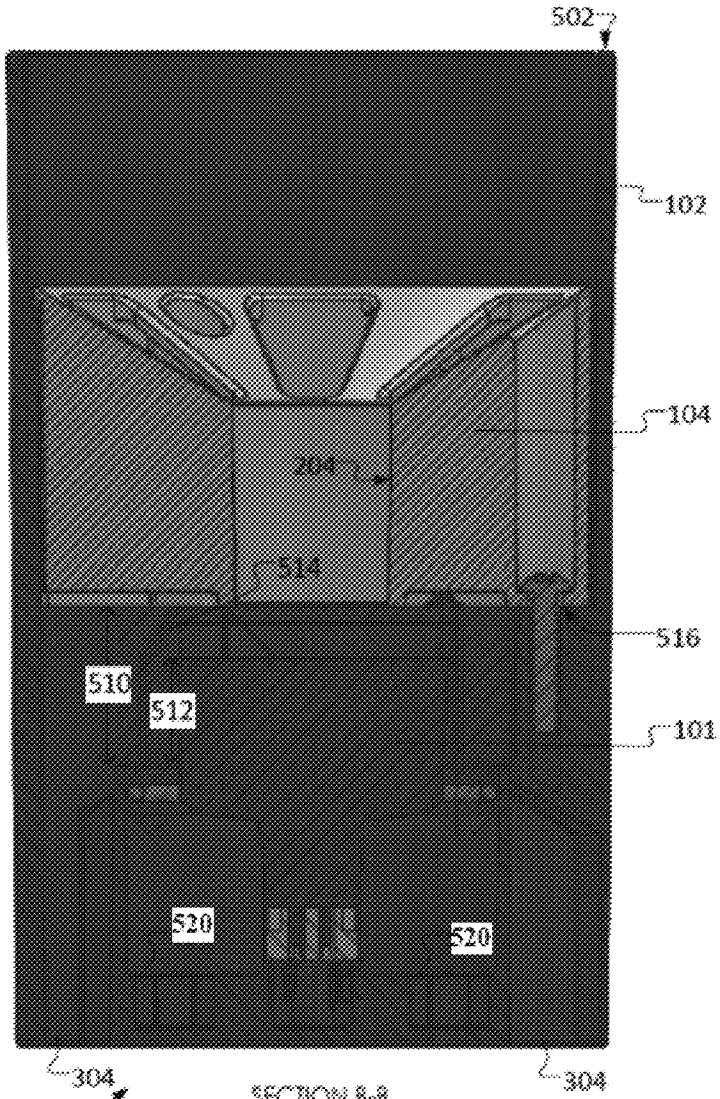
FIG. 5B illustrates a cross-sectional view taken along line B-B of a portion of the golf cup lighting fixture shown in FIG. 4, according to one or more embodiments of the present disclosure.
Figure 5A:
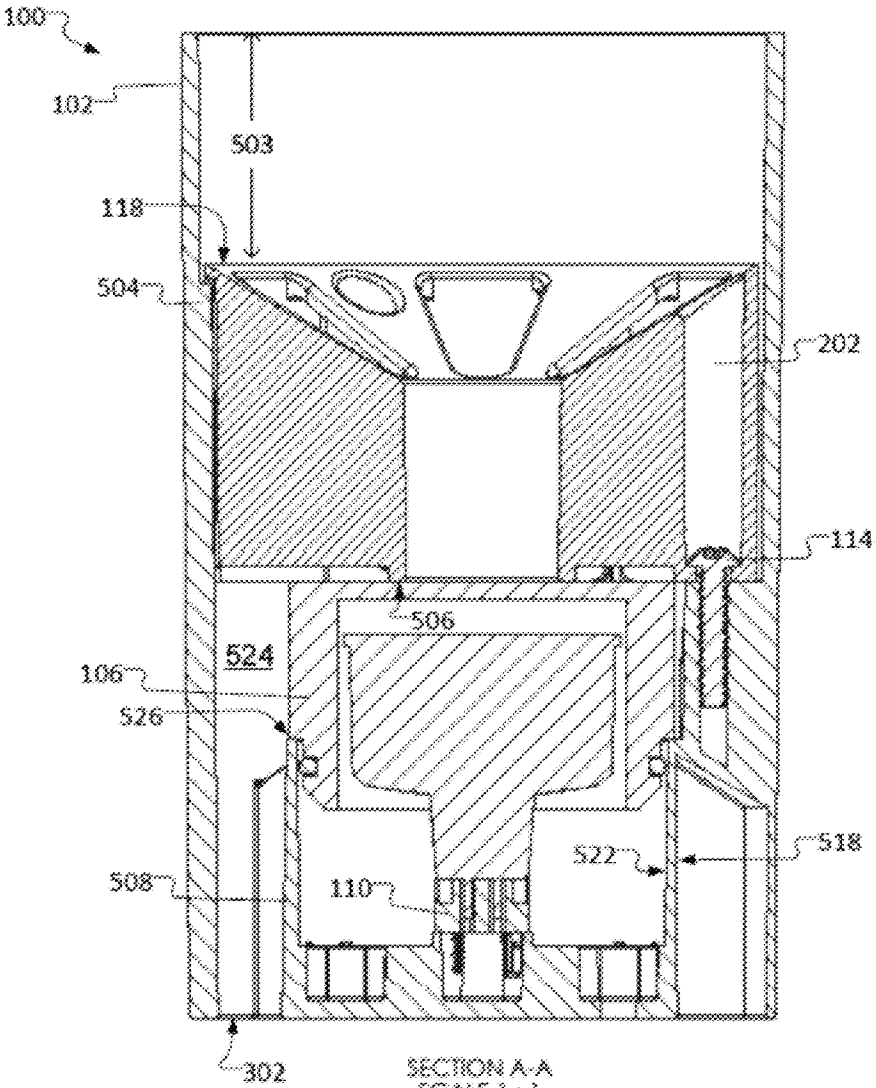
FIG. 5A illustrates a cross-sectional view taken along line A-A of a portion of the golf cup lighting fixture shown in FIG. 4, according to one or more embodiments of the present disclosure.

FIG. 4 illustrates a side view of the golf cup lighting fixture 100 of FIG. 1 assembled with a light source 101 installed therein, according to one or more embodiments of the present disclosure. Line A-A and line B-B are positioned along the longitudinal center of golf cup lighting fixture 100 to create cross sectional views of FIG. 5A and FIG. 5B, respectively. FIG. 5A illustrates a cross-sectional view taken along line A-A of a portion of the golf cup lighting fixture 100 shown in FIG. 4, according to one or more embodiments of the present disclosure. FIG. 5B illustrates a cross-sectional view taken along line B-B of a portion of the golf cup lighting fixture shown in FIG. 4, according to one or more embodiments of the present disclosure. FIG. 5B is a shaded illustration that shows the same components as shown in FIG. 5A. For simplicity, FIGS. 5A-5B are referred to as FIG. 5.

As shown in FIG. 5, the top surface 502 of the outer wall of golf-ball cup 102 forms a rim. When a golf ball travels across the rim at the top surface 502, the golf ball falls into hollow space at the upper portion of golf-ball cup 102, and this hollow space is defined by the inner diameter of golf-ball cup 102 and the top surface 118 of ball-catch 104. The golf ball falls at least a ball-drop distance 503. The distance from the rim at the top surface 502 of golf-ball cup 102 down to the top surface 118 of ball-catch 104 is defines a ball-drop distance 503.

In one embodiment, golf-ball cup 102 includes an inner, truncated wall 508, and an outer wall defined in part by exterior and inner surfaces 112 and 122 respectively (FIG. 2). The truncated wall 508 of golf-ball cup 102 is defined in part by its own outer and inner surfaces 518 and 522, respectively. The inner surface 122 of the golf-ball cup 102, as depicted, includes protruding key 504, which is illustrated by the increased thickness of the outer wall of golf-ball cup 102 on the left side of golf-ball cup 102 relative to the smaller thickness of the outer wall of golf-ball cup 102 on the right side of golf-ball cup 102.

Figure 6:
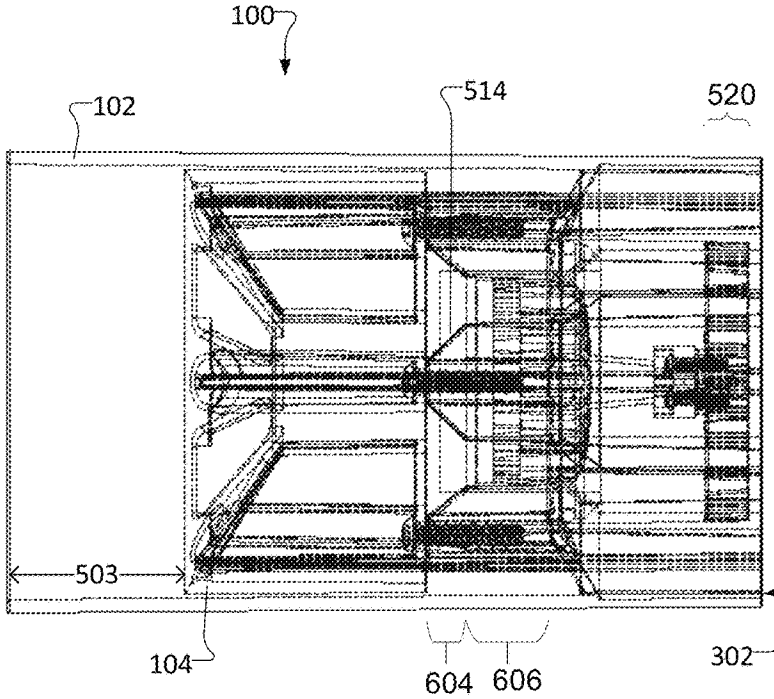
FIG. 6 illustrates a side view of the golf cup lighting fixture shown in FIG. 4 positioned a horizontal orientation.

The golf-ball cup 102 includes interior down-guides 514 that are located beneath ball-catch 104 and that extend downward from the bottom surface 506 of ball-catch 104. The shape of interior down-guides 514 includes an angled portion 604 (FIG. 6) that is sloped (e.g., not completely vertical; partially horizontal) downward. In the depicted embodiment, the shape of interior down-guides 514 further includes a completely vertical portion 606 (FIG. 6).

The golf cup lighting fixture 100 provides an advantage of guiding liquid received through the open top to drain down and out through drainage holes 304 in the bottom surface 302 of the golf-ball cup 102. In one embodiment, the golf cup lighting fixture 100 guides liquid to drain through an annular space between the inner surface 122 golf-ball cup 102 and the outer surface of ball-catch 104. In at least one embodiment, the clearance space along the outer surface of ball-catch 104 is sloped downward, being wider at the top and narrower at the bottom. For example, the inner surface 122 of golf-ball cup 102 is tapered. As another example, the outer surface of ball-catch 104 is correspondingly tapered.

In one embodiment the golf cup lighting fixture 100 guides liquid to drain though middle of flagstick hole. A drainage gap is formed between the bottom surface 506 of ball-catch 104 and the top surface of light source cover 106, and the gap allows liquid move out down into an annular hollow space 524 (herein referred to as the "first finger-gap" 524) between the inner surface 122 of the outer wall of golf-ball cup 102 and both the outer surface 518 of the truncated wall 508 and the outer surface of the side wall (e.g., cylindrical wall) of light source cover 106. Liquid that enters the first finger-gap 524 is pulled down by gravity and drains out of drainage holes 304 in the bottom surface 302 of golf-ball cup 102.

Figure 9:
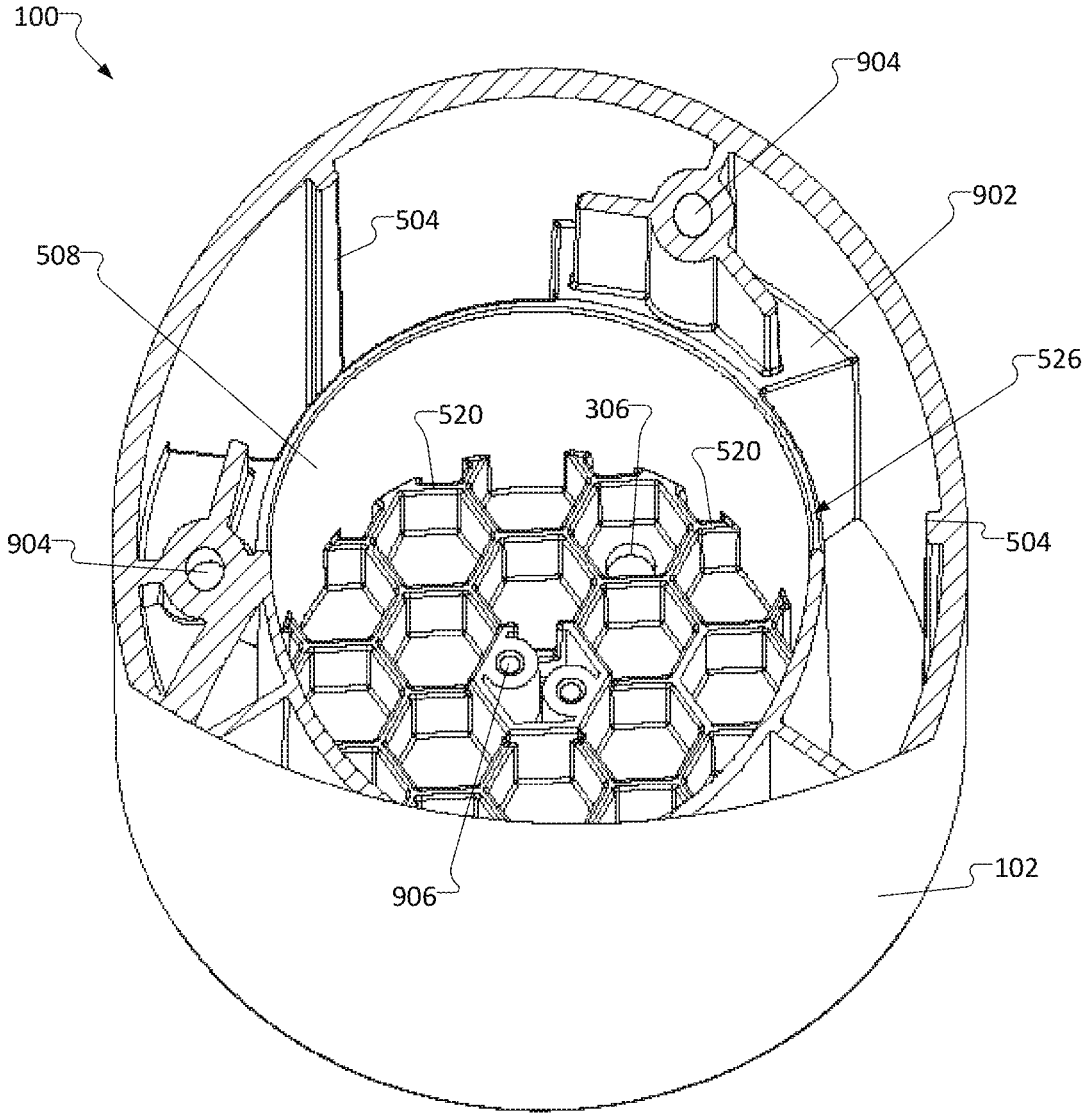
FIG. 9 illustrates a top perspective of cutaway view of the golf cup lighting fixture of FIG. 2 with certain components removed.

The height of the truncated wall 508 extends from bottom surface 302 of golf-ball cup 102 up to the top surface 526 of truncated wall 508. The three-dimensional annular shape of the top surface 526 of truncated wall 508 is depicted in FIG. 9. The outer surface of the side wall of light source cover 106 includes a recess that forms a flange that rests atop the top surface 526 of truncated wall 508. That is, the top surface 526 of truncated wall 508 is positioned beneath the top surface of the light source cover 106 by a distance 510. The top surface 526 of truncated wall 508 is positioned beneath the top surface of light source 101 by a distance 512. Inside first finger-gap 524, distance 510 allows fingers to grasp the outer surface of the cover 106 for removal. After light source cover 106 is removed, an enlarged annular hollow space (herein referred to as the "second finger-gap) is created between the inner surface 122 of the outer wall of golf-ball cup 102 and the outer surface of light source 101. That is, the second finger gap includes all of the first finger gap 524 plus volume previously occupied by the now removed cover 106. Inside the second finger-gap, distance 512 allows fingers to grasp light source 101 for removal.

In an alternate embodiment in which the height of truncated wall 508 extend higher, namely, up to the top of the light source cover 106, then fingers would not be able to grip the cover 106 and light source 101. In this alternate embodiment, a bulb-removal tool would be needed to remove the light source cover 106 and light source 101 as a result of decreasing distances 510 and 512 to an amount that impedes fingers from grasping the light source cover 106 and/or light source 101.

In one embodiment, the golf-ball cup 102 is a unitary body that includes bracing structure 520 formed at the interior bottom of the cup. Additional details about bracing structure 520 are shown and described with reference to FIG. 9. This specific embodiment demonstrates one type of bracing structure which can be utilized. This disclosure is for illustrative purposes only and should not be deemed limiting.

In some embodiments, ball-catch 104 resists being crushed, as portions are solid between top surface 118 to the bottom surface 506, which portions provides physical structure that supports the weight of ball-catch 104 and withstands other forces. Other portions of the ball-catch 104 include an open-top screw channel 202 formed in an otherwise solid portion of the ball-catch 104. Each of the screws 114 is screwed through a respective screw hole 516 through the bottom of each open-top screw channel 202.

Figure 8:
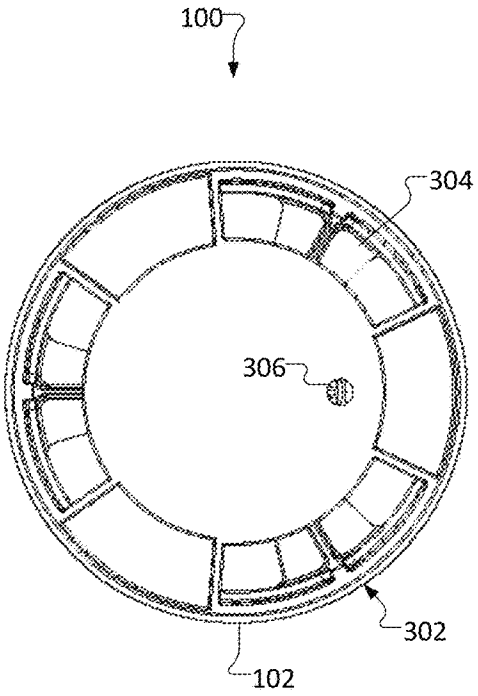
FIG. 8 illustrates a bottom view of the golf cup lighting fixture shown in FIG. 4.
Figure 7:
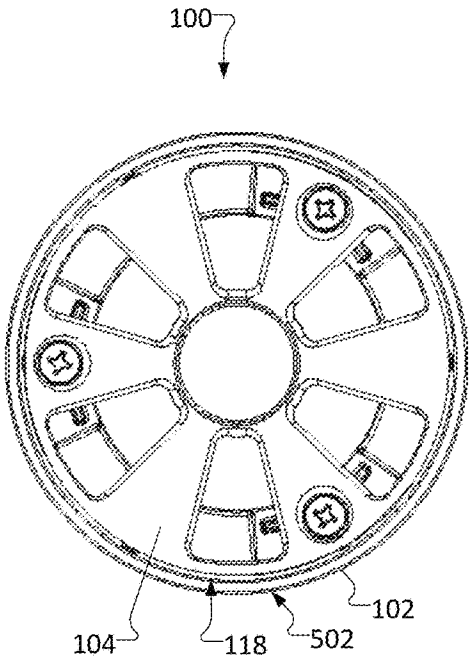
FIG. 7 illustrates a top view of the golf cup lighting fixture shown in FIG. 4.

FIG. 6 illustrates a side view of the golf cup lighting fixture 100 shown in FIG. 4 positioned a horizontal orientation. As shown in FIG. 6, the golf-ball cup 102 is a unitary body that includes bracing structure 602 formed at the interior bottom of the cup. Additional details about bracing structure 602 are shown and described with reference to FIG. 9. The shape of interior down-guides 514 includes angled portion 604 and completely vertical portion 606. FIG. 7 illustrates a top view of the golf cup lighting fixture 100 shown in FIG. 4. FIG. 8 illustrates a bottom view of the golf cup lighting fixture 100 shown in FIG. 4.

FIG. 9 is a top perspective of cutaway view of the golf cup lighting fixture 100 of FIG. 2 with certain components removed. More particularly, screws 114, ball-catch 104, light source cover 106, light source 101, gasket 108, screws 134, and the light source socket 110 are remove from view.

In one embodiment, and as depicted, bracing structure 520 includes honeycomb shaped ribs. Heat from the light source 101 may introduce pressure inside the cup, but the round walls combat the pressure. The honeycomb ribbing of bracing structure 520 prevents the bottom surface of the golf-ball cup 102 from softening or deforming, for example by dissipating the heat over a surface area larger than a flat bottom surface of golf-ball cup 102.

In one embodiment, platform 902 (e.g., mounting box) attaches to and releasably detaches from ball-catch 104. The platform 902, in the embodiment depicted, has a sloped top surface that slopes downward from its most interior side, which is in contact with the low-wall 508, to its outer side, which is in contact with the interior side of the outer wall of the golf-ball cup 102. The downward slope of the platform 902 guides water down toward drainage holes 304 in the bottom surface 302 of golf-ball cup 102.

As shown, the screw holes 904 are formed on top of platform 902. The screw holes 904 extend vertically from the bottom surface 506 of ball-catch 104 to the top surface of platform 902. The interior of golf-ball cup 102 includes screw holes 906 (FIG. 9) for fastening with screws 134.

Figure 10:
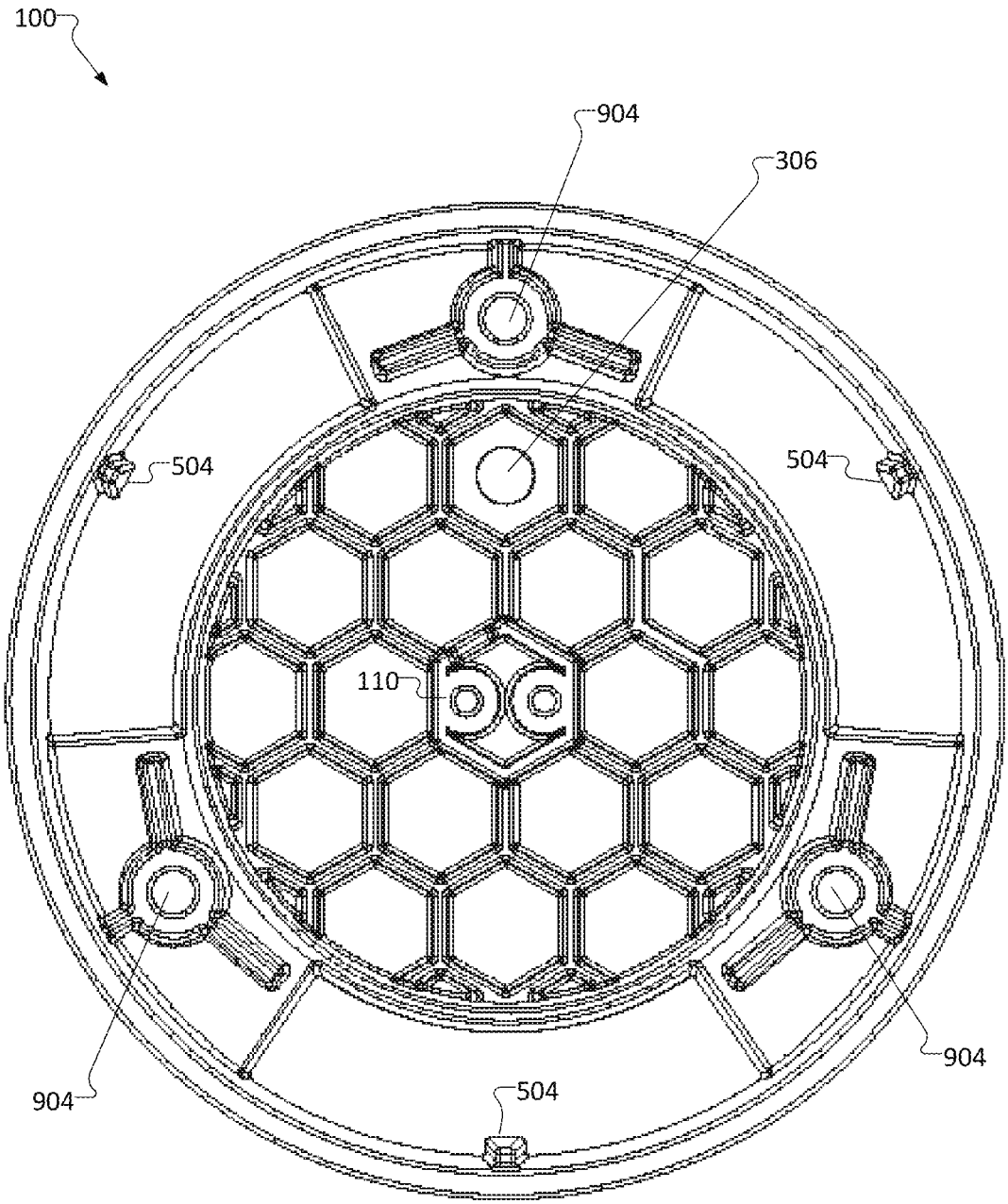
FIG. 10 illustrates a top view of the cutaway view of the golf cup lighting fixture of FIG. 9.

FIG. 10 is a top view of the cutaway view of the golf cup lighting fixture of FIG. 9.

As shown, in one embodiment, the interior wall of golf-ball cup 102 includes multiple protruding keys 504, for example, three protruding keys 504 positioned equidistant (i.e., 120°) apart from each other. Each protruding key 504 concurrently slides into a corresponding opening 130 of a keyhole 124, which enables respective screw holes 516 (FIG. 5) at the bottom of each open-top screw channel 202 (FIG. 5) to vertically align with corresponding threaded screw holes 904 (FIG. 9) at the top of the platform 902 of golf-ball cup 102.

Figure 13:
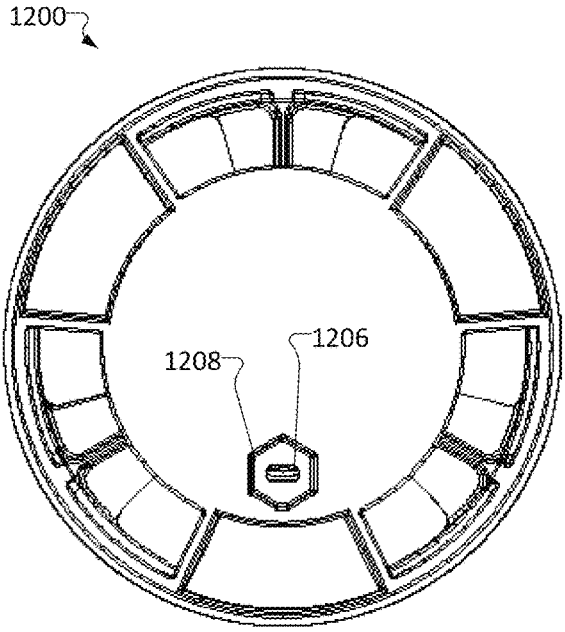
FIG. 13 illustrates a bottom view of the golf cup lighting fixture shown in FIG. 12.
Figure 12:
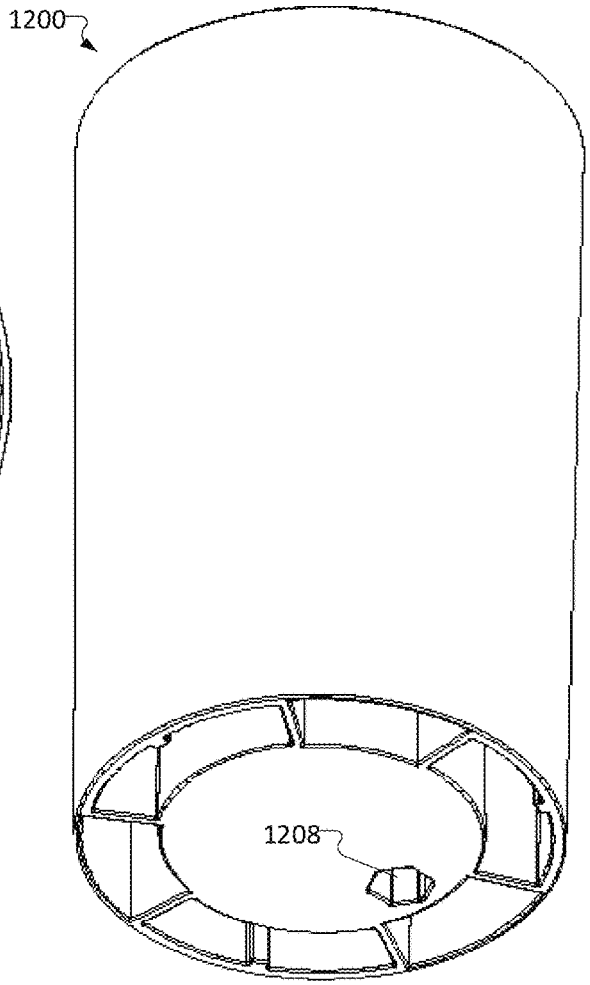
FIG. 12 illustrates a bottom perspective view of a golf cup lighting fixture having an oblong shaped cable port, according to one or more embodiments of the present disclosure.
Figure 14:
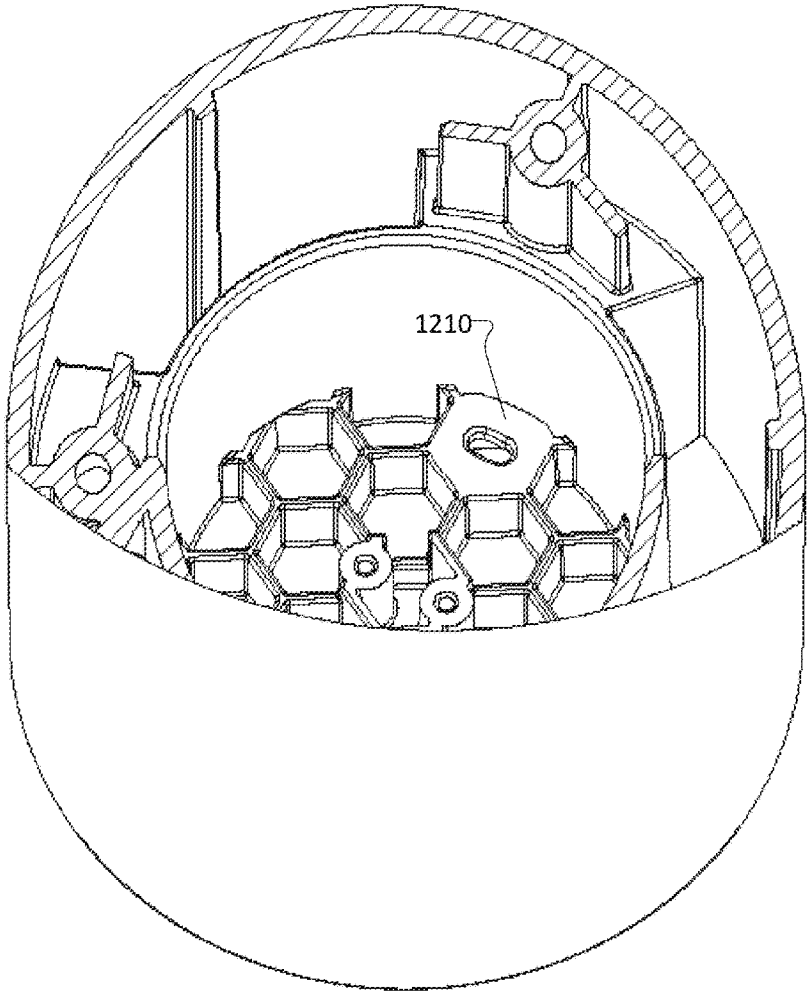
FIG. 14 illustrates a top perspective of cutaway view of the golf cup lighting fixture of FIG. 12 with certain components removed.
Figure 15:
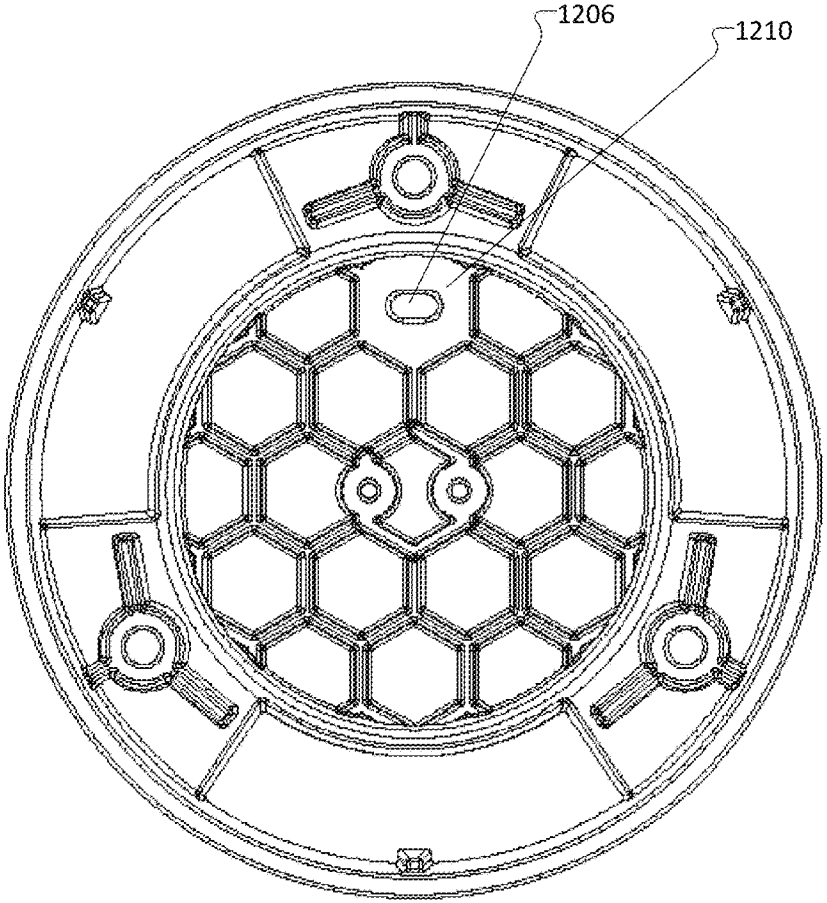
FIG. 15 illustrates a top view of the cutaway view of the golf cup lighting fixture of FIG. 14.

FIG. 12 illustrates a bottom perspective view of a golf cup lighting fixture 1200 having an oblong shaped cable port 1206, according to one or more embodiments of the present disclosure. FIG. 13 illustrates a bottom view of the golf cup lighting fixture shown in FIG. 12. FIG. 14 illustrates a top perspective of cutaway view of the golf cup lighting fixture of FIG. 12 with certain components removed. FIG. 15 illustrates a top view of the cutaway view of the golf cup lighting fixture of FIG. 14. It is understood that a golf cup lighting fixture 1200 of FIGS. 12-15 is similar to and includes the same or similar components as golf cup lighting fixture 100 of FIG. 1. The cable port 1206, as shown, has an oblong shape that matches (e.g., is concentric with; or having same shape and size) the oblong shape of the cable that will be potted, as described above. By matching the shape of the cable port 1206 with the shape of the cable to be potted, the golf cup lighting fixture 1200 reduces the size of the path through which potting material can leak during the potting process, thereby minimizing the amount of potting material that leaks out of cable port 1206 during the potting process. The honeycomb (hexagonal) ribbing bracing structure 520 that surrounds cable port 1206 is concave, as illustrated by the open bottom hexagon 1208 (FIGS. 12-13) and the closed top 1210 (FIGS. 14-15). That is, oblong shaped cable port 1206, is a hole through the closed top 1210. The concave profile of the ribbing bracing structure 520 that surrounds cable port 1206 allows for easier installation of the potting material from the outside of golf cup lighting fixture 1200 and allows a landscape professional to inspect the quality of the potting process after the potting process is complete. By way of comparison, the honeycomb (hexagonal) ribbing bracing structure 520 that surrounds cable port 106 (FIG. 9) is convex, with cable port 106 being a hole through closed, flat bottom surface 302 (FIG. 3).

Figure 16:
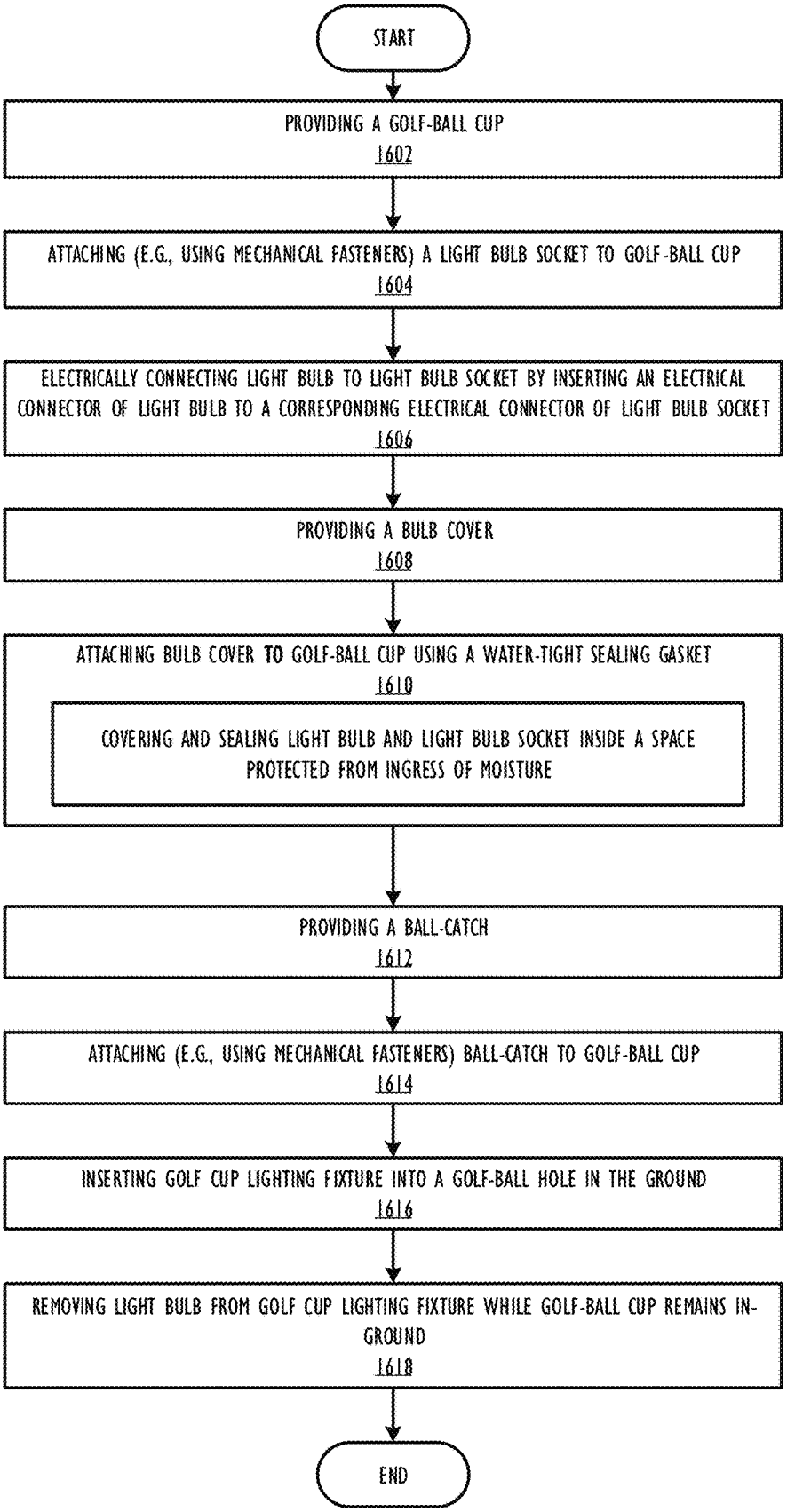
FIG. 16 illustrates a method of manufacturing the golf cup lighting fixture of FIG. 1 with a light source installed therein, according to one or more embodiments of the present disclosure.

FIG. 16 illustrates a method of provisioning (e.g., manufacturing) the golf cup lighting fixture of FIG. 1 with a light source installed therein, according to one or more embodiments of the present disclosure. The provisioning can be completed by an automation/manufacturing system that is controlled by one or more automation computer systems. In one embodiment, at block 1602, method 1600 includes providing a golf-ball cup 102. At block 1604, method 1600 includes attaching (e.g., using mechanical fasteners) a light source socket 110 to golf-ball cup 102. At block 1606, method 1600 includes electrically connecting light source 101 to light source socket 110 by inserting an electrical connector of light source 101 to a corresponding electrical connector of light source socket 110. At block 1608, method 1600 includes providing light source cover 106. At block 1610, method 1600 includes attaching the light source cover 106 to golf-ball cup 102 using a water-tight sealing gasket 108. In at least one embodiment of method 1600, attaching the light source 106 to golf-ball cup 102 includes covering and sealing the light source 101 and light source socket 110 inside a space protected from ingress of moisture. At block 1612, method 1600 includes providing ball-catch 104. At block 1614, method 1600 includes attaching (e.g., using mechanical fasteners) ball-catch 104 to golf-ball cup 102. At block 1616, method 1600 includes inserting golf cup lighting fixture 100 into a golf-ball hole in the ground. At block 1618, method 1600 includes removing light source 101 from golf cup lighting fixture 100 while golf-ball cup 102 remains in-ground.

In the above-described flowchart, one or more of the methods may be embodied in a computer readable medium containing computer readable code such that a series of functional processes are performed when the computer readable code is executed on a computing device. In some implementations, certain steps of the methods are combined, performed simultaneously or in a different order, or perhaps omitted, without deviating from the scope of the disclosure. Thus, while the method blocks are described and illustrated in a particular sequence, use of a specific sequence of functional processes represented by the blocks is not meant to imply any limitations on the disclosure. Changes may be made with regards to the sequence of processes without departing from the scope of the present disclosure. Use of a particular sequence is therefore, not to be taken in a limiting sense, and the scope of the present disclosure is defined only by the appended claims.

While conventional submersible light assembly designed to be mounted underwater, such as a brass water feature fountain light assembly, for example, can be utilized, such assemblies are made from brass. As such, these are expensive compared to those made from plastic material or polymer material.

As noted, in other light assemblies, to perform maintenance (e.g., exchange the power source (e.g., battery); recharge the battery; or change the light source, bulb, etc.) inside the electrical module, the landscape professional must endure tedious labor to remove the entire conventional golf cup light assembly from the golf ball hole, plus the time and energy to re-install the conventional golf cup light assembly after repair. This requires the consumer to remove the electrical module from the golf ball hole in order to recharge the battery, which may need to be recharged after approximately every two days. Other light assemblies are not battery-powered, but instead receive power at a standard voltage level of substantially 120 volts or receive power from at a low-voltage level (for example, 12 volts) via a low-voltage transformer. In cases in which each light requires a separate low-voltage transformer, a landscape professional must iteratively install a transformer per golf ball hole. Multiple low-voltage transformers consume more real estate at a space-limited putting green than the smaller amount of space that is consumed by wires, which wires are buried and connect the conventional golf cup light assembly to conductor of a 120-volt circuit. As noted, the method and system described herein allows the light source or bulb to be modified, replaced, etc. without any additional tools and without removing the cup. Thus, a user can replace the bulb, for example, using the user's own hands and without disturbing the dirt surrounding the hole.

Figure 18:
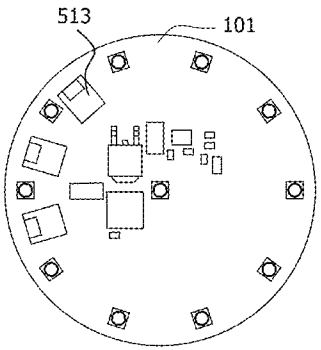
FIG. 18 illustrates a top plan view of the LED board in one embodiment.
Figure 17:
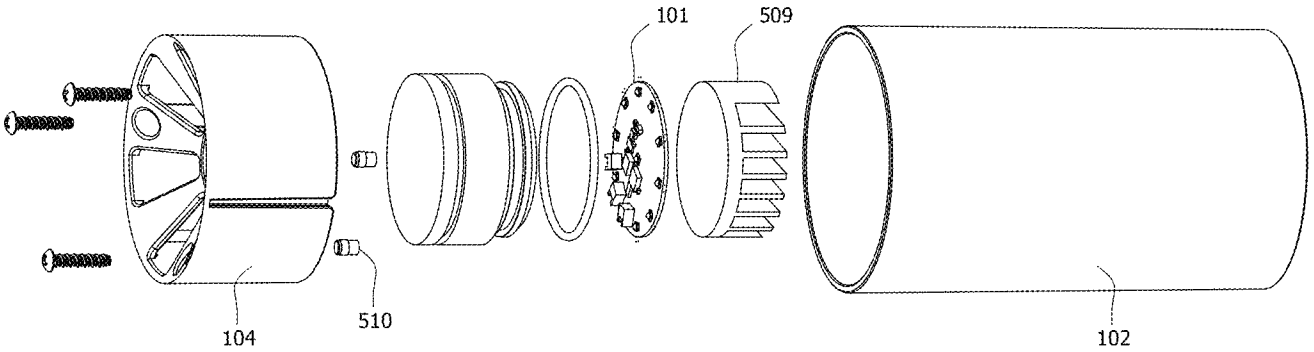
FIG. 17 illustrates a perspective view of one embodiment utilizing an LED board.

FIG. 17 illustrates a perspective view of one embodiment utilizing an LED board, and FIG. 18 illustrates a top plan view of the LED board in one embodiment. As noted, in one embodiment the light source 101 can comprise an LED. In the figure depicted, the LED is on an LED board, which can include a custom LED board. In one embodiment, the LED board has connectors 513 which allow easy and quick connections to the LED board. These connectors can be used for replacement and adding of additional sensors, external charging such as solar powered solar stick, external battery pack, etc. The LED board offers increased versatility.

Also depicted in FIG. 17 is a heatsink 509. The heatsink 509 fits within the main housing and allows for tool-less removal of the heatsink and the LED board. The heatsink 509 dissipates the heat produced by the light source.

Also depicted in FIG. 17 is a plurality of sensors 510. Various sensors 510 can be utilized to enhance the operation of the system. There is one sensor located in line with the flat hole. This can sense the removal of the flag and alter the operation of the system accordingly. As but one example, in one embodiment when the flag is removed, the light source 101 will dim. A separate sensor 510 is placed to detect the presence of the ball in the catch 104. As but one example, the light source 101 can flash or change colors to indicate that the ball has been received by the catch 104. These two sensors 510 are described as non-limiting examples of how the sensors can enhance and modify the operation of the system.

Figure 19:
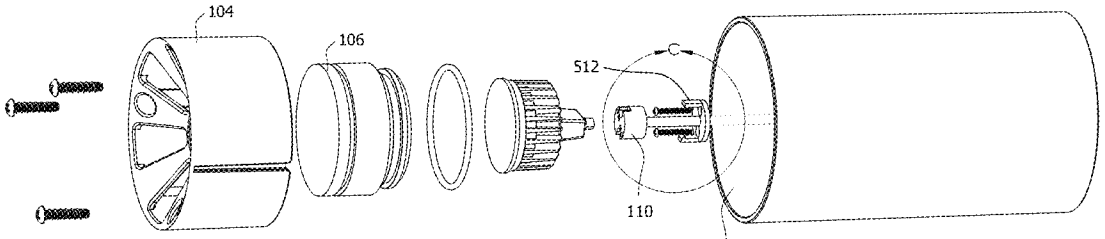
FIG. 19 illustrates a perspective view of an embodiment utilizing pig tail wire and a quick connector.

FIG. 19 illustrates a perspective view of an embodiment utilizing pig tail wire and a quick connector. The wire 511 provides electrical energy to the light source 101 via the light source socket 110. As noted, the electrical energy can come from the grid, solar panels, batteries, etc. Either way, energy is passed to a socket 110 where it is delivered to the light source 101. The wire 511 serves as a tether to tie the socket to the cup 102, in some embodiments. Accordingly, adjusting and manipulating the socket 110 is often limited by the size and length of the wire 511. In one embodiment the wire 511 is of a sufficient length that the socket 110 can be pulled out of the cup 102 to allow replacement of the light source 101, maintenance, etc. In one embodiment the wire 511 has a pig-tail shape similar to handheld phone chords. This allows the wire 511 to be stored in such a way to allow the socket 110 to be manipulated easily and freely.

As depicted, there is a quick connect 512. The quick connect 512, as depicted, couples to the cup 102 via screws. As previously, while screws are depicted, this is for illustrative purposes only and should not be deemed limiting. As shown the quick connect 512 has two connectors which releasably couple with the socket 110. As shown, this allows for tool-less decoupling of the socket 110 from the quick connect 512. The connectors can be pushed outward to release engagement with the socket 110. In one embodiment the user reaches to the bottom of the cup and decouples the socket 110 via the quick connect 512. Then, due to the length of the wire 512, the user can pull the socket 110 out of the cup 102 where it is easier to manipulate. The user can then replace the light source 101 or conduct any other necessary maintenance.

While the disclosure has been described with reference to embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A system for a golf cup lighting fixture, said system comprising:

a cup, said cup comprising:

a truncated wall which extends from a bottom of said cup, wherein said truncated wall comprises an outer wall, and wherein there is an annular hollow space between said outer wall of the truncated wall and an inner wall of said cup, and wherein liquid enters into said annular hollow space and exits through at least one drainage hole located in the bottom of said cup;

a light source;

a catch removeably coupled to said cup;

a cover located below said catch which covers said light source;

wherein said light source is accessible when said catch and said cover are removed.

2. The system of claim 1 wherein said light source is accessible and can be removed with human fingers without additional tools.

3. The system of claim 1 wherein said cup comprises a platform, and wherein screws couple said catch to said platform.

4. The system of claim 1 wherein said cover comprises an annular grove which couples with a gasket.

5. The system of claim 4 wherein said light source cover and said gasket are fully submersible in water and do not allow moisture to enter the interior of the light source cover.

6. The system of claim 1 wherein said catch comprises a plurality of drainage holes.

7. The system of claim 1 wherein said cup comprises a plurality of drainage holes on a bottom surface.

8. The system of claim 1 wherein said cup is installed in the ground, and wherein said light source can be replaced while leaving the cup installed in the ground.

9. The system of claim 1 wherein said light source is remotely coupled to a mobile application which provides control over said light source.

10. The system of claim 1 wherein the catch comprises a top surface, and wherein the catch is recessed within said cup such that there is a distance between a top of the cup and said top surface of the catch, and wherein said the top surface of the catch is pitched downward.

11. The system of claim 1 wherein catch has an outer wall, and wherein said outer wall comprises at least one keyhole, and wherein said at least one keyhole engages with a protruding key located on an inner wall of said cup.

12. The system of claim 1 wherein a second annular hollow space is created when said cover is removed.

13. The system of claim 1 wherein said first and second annular hollow spaces provide room for human fingers to grasp the exposed light source.

14. The system of claim 1 wherein said cup comprises bracing structure to enhance the bracing of the cup.

15. The system of claim 1 further comprising at least one sensor wherein said at least one sensor is connected to said light source.

16. The system of claim 1 further comprising a quick connect which couples a light source socket to said cup.

* * * * *